US008961773B2

(12) United States Patent
Fardeau et al.

(10) Patent No.: US 8,961,773 B2
(45) Date of Patent: Feb. 24, 2015

(54) METHOD OF PRODUCING ALUMINIUM IN AN ELECTROLYSIS CELL

(75) Inventors: Sylvain Fardeau, Jarrier (FR); Benoît Sulmont, Chambéry (FR)

(73) Assignee: Rio Tinto Alcan International Limited, Montreal, Quebec (CA)

( * ) Notice: Subject to any disclaimer, the term of this patent is extended or adjusted under 35 U.S.C. 154(b) by 1062 days.

(21) Appl. No.: 12/997,661

(22) PCT Filed: Jun. 5, 2009

(86) PCT No.: PCT/EP2009/004124

§ 371 (c)(1),
(2), (4) Date: Dec. 13, 2010

(87) PCT Pub. No.: WO2009/152975

PCT Pub. Date: Dec. 23, 2009

(65) Prior Publication Data

US 2011/0094891 A1 Apr. 28, 2011

(30) Foreign Application Priority Data

Jun. 16, 2008 (EP) ..... 08356087

(51) Int. Cl.
*C25C 3/06* (2006.01)
*C25C 3/14* (2006.01)
*C25C 3/20* (2006.01)

(52) U.S. Cl.
CPC .... *C25C 3/20* (2013.01); *C25C 3/14* (2013.01)
USPC ..... 205/372; 204/193; 204/194; 204/242; 205/334; 205/364; 205/537; 700/282

(58) Field of Classification Search
CPC ..... C25C 3/06; C25C 3/14; C25C 3/20
USPC ..... 204/193, 194, 242; 205/334, 364, 372, 205/537; 700/282
See application file for complete search history.

(56) References Cited

U.S. PATENT DOCUMENTS 4,654,130 A 3/1987 Tabereaux et al.
5,089,093 A 2/1992 Blatch et al.

(Continued)

FOREIGN PATENT DOCUMENTS

DE 1483343 A1 3/1969
RU 2242540 12/2004

(Continued)

OTHER PUBLICATIONS

International Search Report and Written Opinion mailed Sep. 16, 2009 (PCT/EP2009/004124); ISA/EP.

*Primary Examiner* — Zulmariam Mendez
(74) *Attorney, Agent, or Firm* — Banner & Witcoff, Ltd.

(57) ABSTRACT

The invention relates to a method of producing aluminum in an electrolysis cell, which includes setting up a succession of control periods of duration T, identifying perturbative tending operations on the cell that can introduce superfluous alumina in the electrolytic bath, noting the performance of the perturbative tending operations, determining a regulation feed rate B(k') for each control period k' and setting a specified feed rate SR(k') equal to M(k')×B(k'), where M(k') is a predetermined modulation factor that modulates the regulation feed rate B(k') so as to take into account a reduction of the needs of the cell induced by the superfluous alumina. The method of the invention makes it possible to significantly reduce the rate of occurrence of anode effects.

21 Claims, 8 Drawing Sheets

(56) References Cited

U.S. PATENT DOCUMENTS

Figure 1:
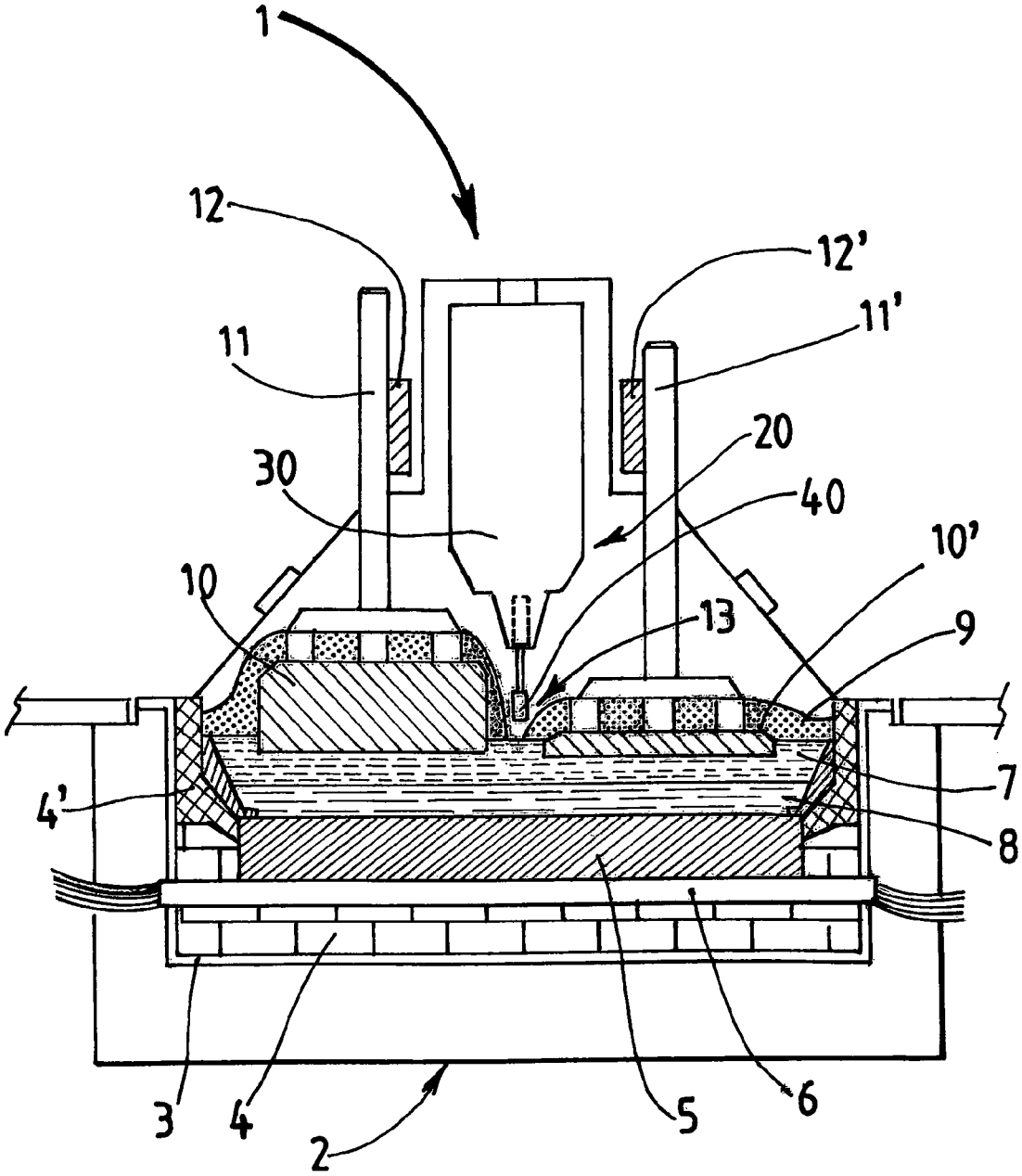

| | | | | |
|---|---|---|---|---|
| 6,033,550 | A * | 3/2000 | Bonnardel et al. | 205/375 |
| 6,126,809 | A | 10/2000 | Larsen | |
| 6,609,119 | B1 | 8/2003 | Meghlaoui | |
| 2009/0159434 | A1 * | 6/2009 | Girault et al. | 204/228.3 |

FOREIGN PATENT DOCUMENTS

| | | |
|---|---|---|
| RU | 2255149 | 6/2005 |
| RU | 2303658 | 7/2007 |

* cited by examiner

METHOD OF PRODUCING ALUMINIUM IN AN ELECTROLYSIS CELL

CROSS-REFERENCE TO RELATED APPLICATIONS/PRIORITY CLAIM

The present application is a U.S. National Phase filing of International Application No. PCT/EP2009/004124 filed on Jun. 5, 2009, designating the United States of America and claiming priority to European Patent Application No. EP08356087.0 filed on Jun. 16, 2008, both of which applications the present application claims priority to and the benefit of, and both of which applications are incorporated by reference herein in their entireties.

FIELD OF THE INVENTION

The invention relates to the production of aluminium by means of electrolysis in an electrolysis cell. The invention more particularly relates to an accurate control of the amount of alumina contained in the electrolytic bath of a cell intended for the production of aluminium by igneous electrolysis.

STATE OF THE ART

According to the Hall-Héroult process that is widely used industrially nowadays aluminium is produced in electrolysis cells by electrolytic reduction of alumina dissolved in a molten salt bath.

A major requirement for obtaining a regular operation of an electrolysis cell is that the alumina consumed by the electrolysis process be properly compensated by the alumina added to the cell.

Deficiencies in the alumina contents of an electrolytic bath lead to the occurrence of the so-called anode effects, i.e., abrupt and large rises of the voltage drop across an electrolysis cell. The occurrence of anode effects reduces the current efficiency of a cell, increases its energy consumption and produces fluorinated compounds that are detrimental to the environment.

Conversely, an excess in alumina supply is conducive to the accumulation of alumina on the cathode of a cell, which may transform into hard coatings that electrically insulate part of the cathode. This phenomenon generates instabilities in the cell by inducing horizontal electrical currents within the liquid metal produced by the electrolytic process, which currents interact with the magnetic fields to stir up the liquid metal and perturb the bath-metal interface.

The need to maintain the alumina concentrations in the electrolytic bath within precise and relatively narrow limits has led to the development of automatic feeding methods. This need has become compulsory with the use of the so-called "acid" electrolytic baths, i.e. electrolytic baths with excess amounts of aluminium fluoride ($AlF_3$) compared to the sodium fluoride content. Indeed, high levels of current efficiency, typically greater than 90%, and low levels of energy consumption per tonne of aluminium produced have been obtained by using acid electrolytic baths and by running the electrolysis cells at relatively low temperatures, typically between 920° and 970° C., and low alumina concentrations in the electrolytic bath, typically between 1% and 3.5%.

Several regulation methods, such as the ones described in U.S. Pat. Nos. 4,431,491, 4,654,129 and 6,033,550 in the name of Aluminium Pechiney, have been devised to achieve this goal.

Accurate alumina feed control has also been made possible by the development of the so-called point feeder devices, such as the one described in U.S. Pat. No. 4,431,491, that make it possible to automatically supply precise amounts of alumina powder at specific locations in a cell.

Despite the noteworthy performance achieved with some of the known regulation methods there remains room for improvement, especially in view of the ever increasing current intensities of the electrolysis cells and of the tightening of the national regulations with respect to environmental concerns. Indeed, increasing the electrolysis current tends to enhance the rate of generation of anode effects whereas many production plants are required to lower their emissions of fluorinated effluents. Moreover, the current trend is to boost the current intensity of electrolysis cells compared to the amount of electrolytic bath contained in the cells, i.e., to increase the current intensity-to-bath ratios of electrolysis cells. For example, in the AP technology, the current intensity-to-bath weight ratio went from values between about 30 and 35 kA/tonne to values above about 50 kA/tonne. Larger current intensity-to-bath weight ratios lead to faster and, possibly, greater fluctuations of the alumina concentration in the electrolytic bath, so that the lower frequencies of occurrence of anode effects that could be achieved with known regulation methods were no longer accessible.

Therefore, the applicant searched economically and technically satisfactory solutions to cure the drawbacks of known regulation methods, with a view to maintaining the current efficiency at high levels and the rate of anode effects at low levels.

DESCRIPTION OF THE INVENTION

The invention relates to a method of producing aluminium in an electrolysis cell, the cell comprising a pot, a plurality of anodes and at least one alumina feeder device capable of delivering amounts of alumina powder in the cell, the cell containing an electrolytic bath comprising alumina dissolved therein, the anodes and electrolytic bath being covered with a protecting layer made from a powdery material containing alumina, the method including:

circulating an electrical current having intensity I through the cell, so as to reduce the alumina and thereby produce liquid aluminium, performing tending operations on the cell, selecting an electrical parameter EP for the cell that is sensitive to the alumina concentration in the electrolytic bath, setting up a succession of control periods of duration T, measuring the electrical parameter EP during each control period, determining a rate of variation P(k) of the electrical parameter EP during at least one previous control period k, selecting at least a slow feed rate $B_s$ and a fast feed rate $B_f$, determining a regulation feed rate B(k') for a subsequent control period k' by setting the regulation feed rate B(k') equal to the fast feed rate $B_f$ if the rate of variation P(k) has exceeded a reference variation value $P_o$ and equal to the slow feed rate $B_s$ when an underfeeding criterion has been met, adding alumina at a specified feed rate SR(k') during the subsequent control period k', wherein the method further includes:

identifying perturbative tending operations on the cell that can introduce superfluous alumina in the electrolytic bath, noting the control periods $k_p$ during which any one of the perturbative tending operations on the cell is initiated, setting the specified feed rate SR(k') equal to M(k')×B(k'), where M(k') is a predetermined modulation factor that modulates the regulation feed rate B(k') so as to take into account a reduction of the needs of the cell induced by the superfluous alumina.

It has been observed that some tending operations add significant amounts of superfluous alumina to an electrolytic bath and thereby significantly reduce the apparent needs of a cell. As a result, the cell displays an apparent consumption rate significantly below its usual consumption rate for a while after the beginning of the perturbative tending operations.

The Applicants noted that a feeding control method that can be very efficient in a steady-state situation may not be sufficiently efficient in a perturbed situation, especially during the aftermath of major tending operations, such as the anode replacement operations or, to a lesser extent, the tapping of liquid metal from a cell.

The Applicants further noted that the regulation of the alumina feeding is much more reliable when the point of reference for the determination of the feed rate, which is typically a basic feed rate, is close to the actual needs of a cell. Otherwise, the regulation tends to give rise to an effective underfeeding rate of the cell that deviates significantly from the slow feed rate $B_s$ that is used in the regulation. For example, it has been observed that a slow feed rate $B_s$ that would be set equal to a value that is 25% below the basic alumina consumption rate of a cell in a steady-state situation would result in an effective underfeeding rate that typically could vary between 10 and 40% below the basic alumina consumption rate of the cell in a perturbed situation. The Applicants noted that this variation significantly increases the probability of occurrence of anode effects.

The Applicants further observed that the apparent alumina consumption rate of a cell varies with time according to a fairly reproducible pattern and, in particular, stays significantly below the steady-state consumption rate of a cell for a fairly reproducible period of time, after the beginning of the perturbative tending operations.

The Applicants further noted that an apparent consumption rate could efficiently be taken into account by properly modulating a reference regulation feed rate. The modulation factor M(k') is typically predetermined in an empirical manner by monitoring the apparent consumption rate of a given cell in the aftermath of the initiation of selected perturbative tending operations. The modulation factor M(k') may advantageously be predetermined by running the cell or a similar cell, by recording the resulting needs Q(t) of the cell as a function of time (before, during and after selected perturbative tending operations) and by setting M(k') equal to a mathematical function that makes it possible to substantially match the resulting needs Q(t) during and after the performance of perturbative tending operations.

The Applicants further noted that a method according to the invention, which takes into account the perturbative effects of some major tending operations, may be used to better control the alumina content of a cell and thus reduce the rate of occurrence of anode effects.

The Applicants further noted that the regulation feed rate could advantageously be adjusted to take into account the actual needs of individual cells in a series of cells.

Figure 2:
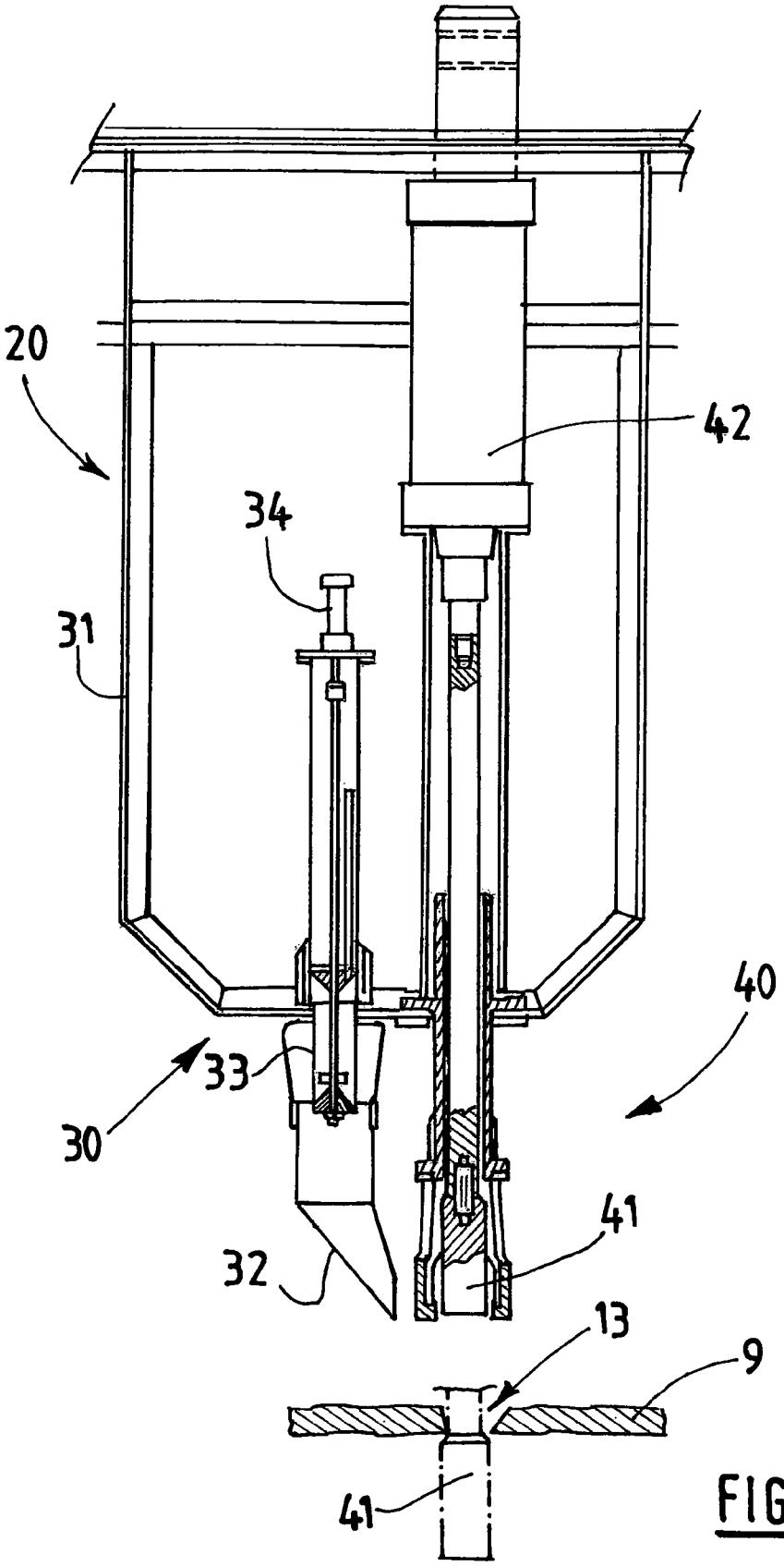
Figure 3:
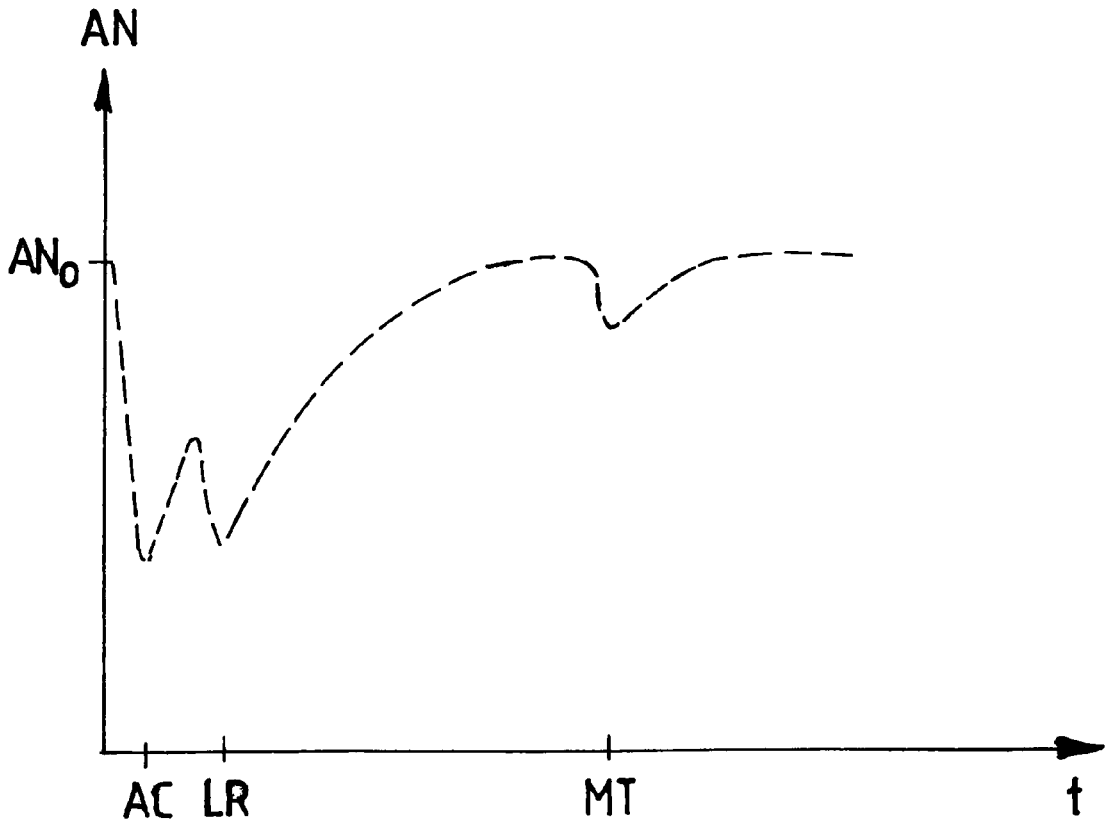
Figure 4:
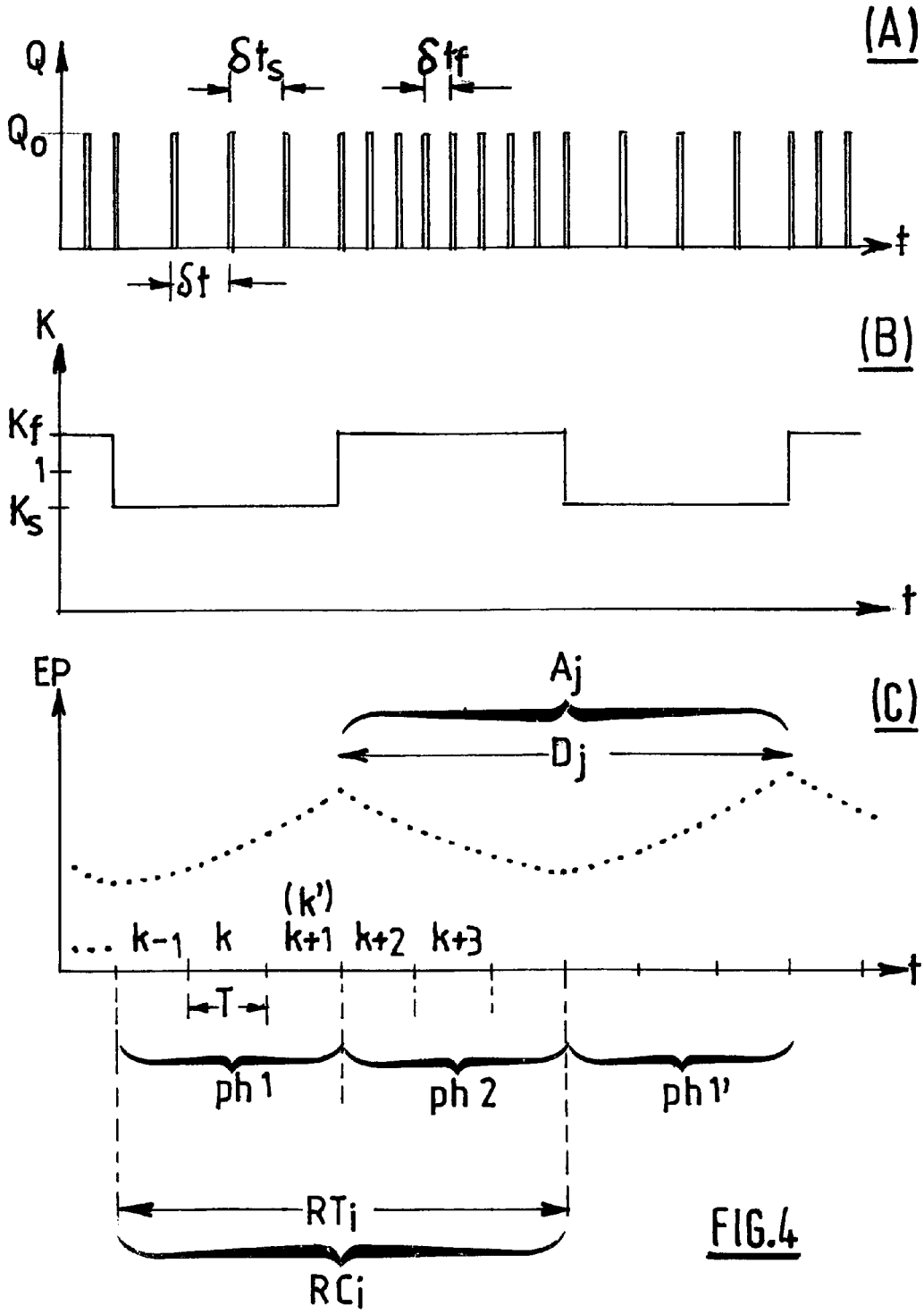
Figure 5:
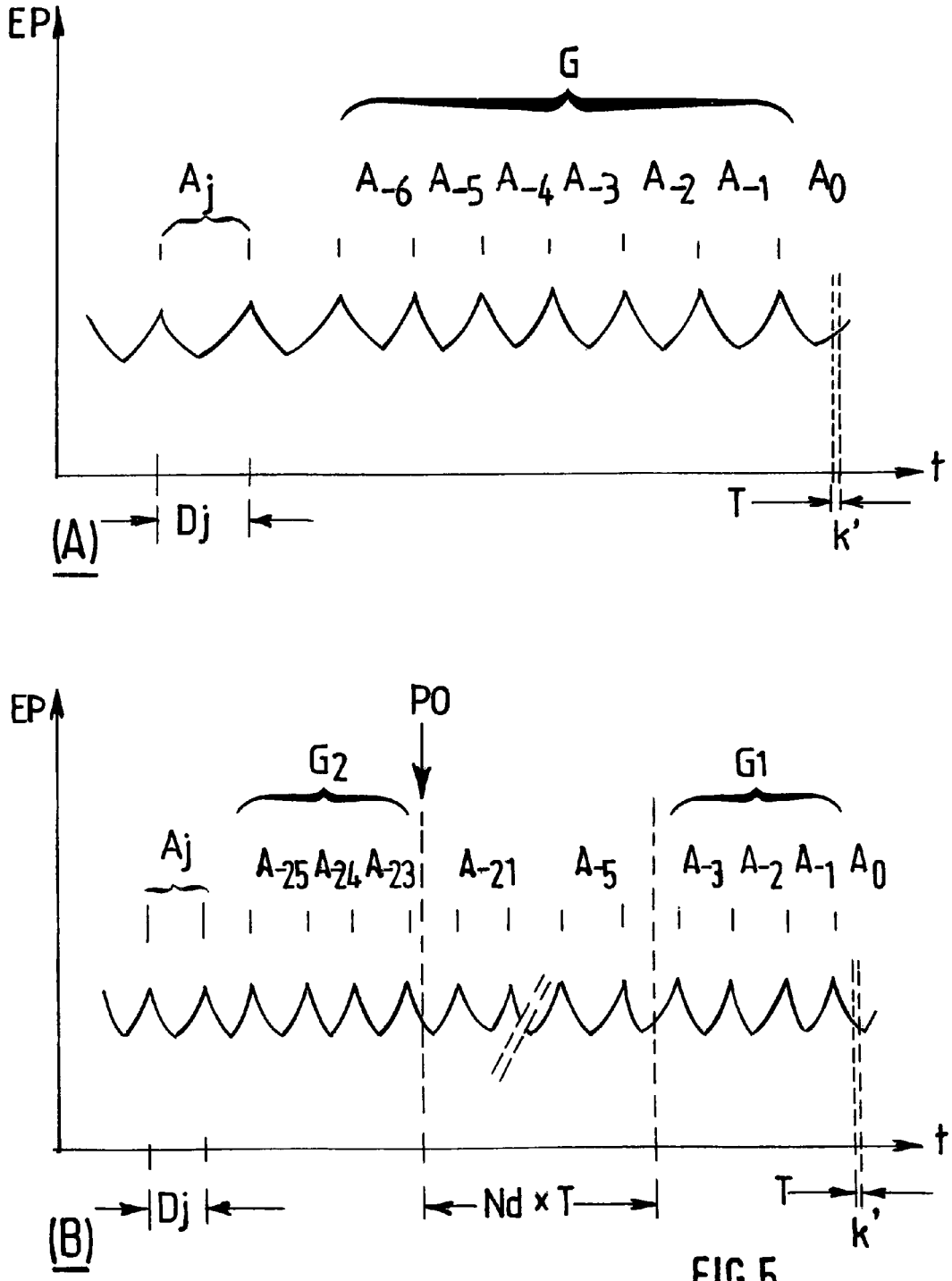
Figure 6:
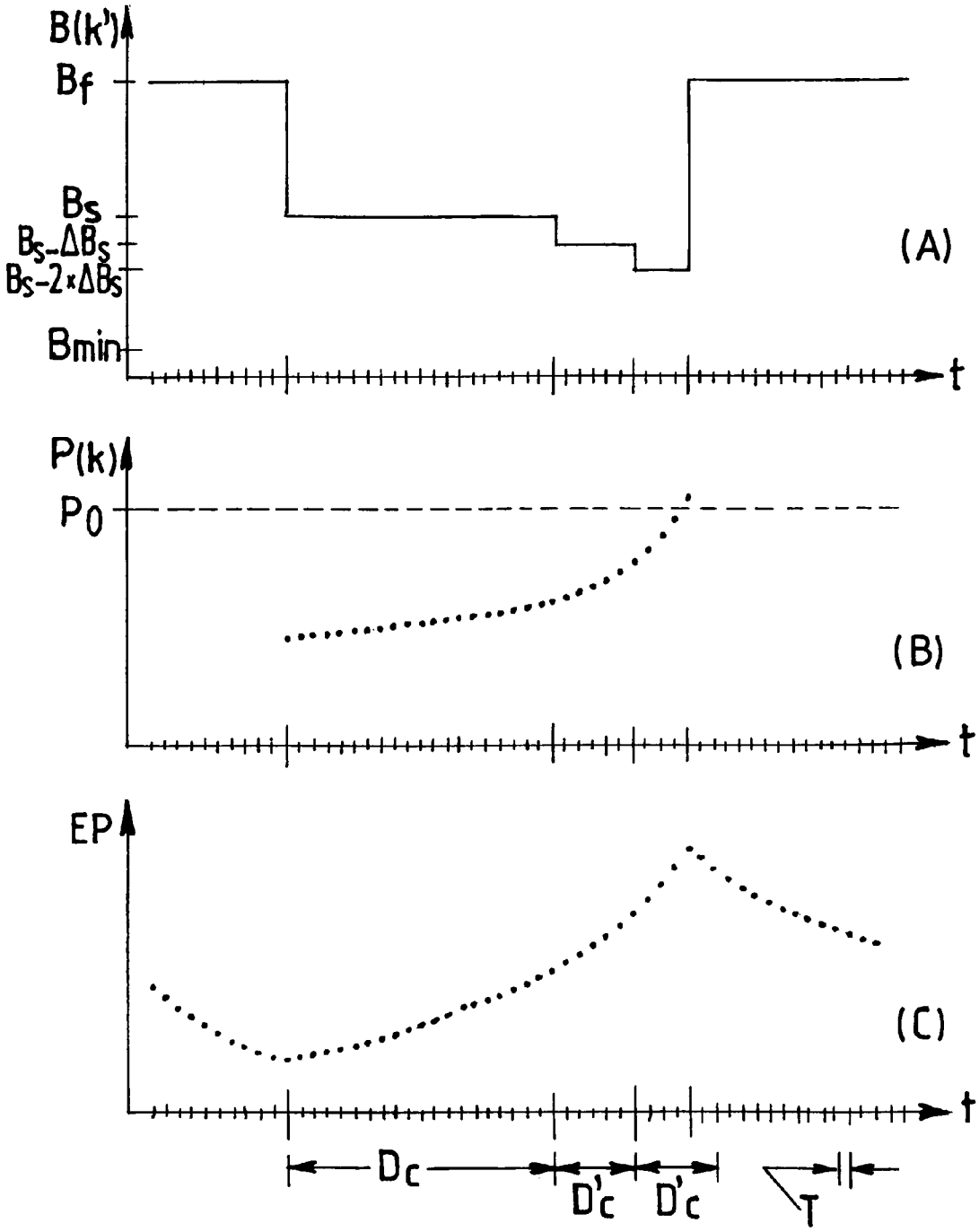
Figure 7:
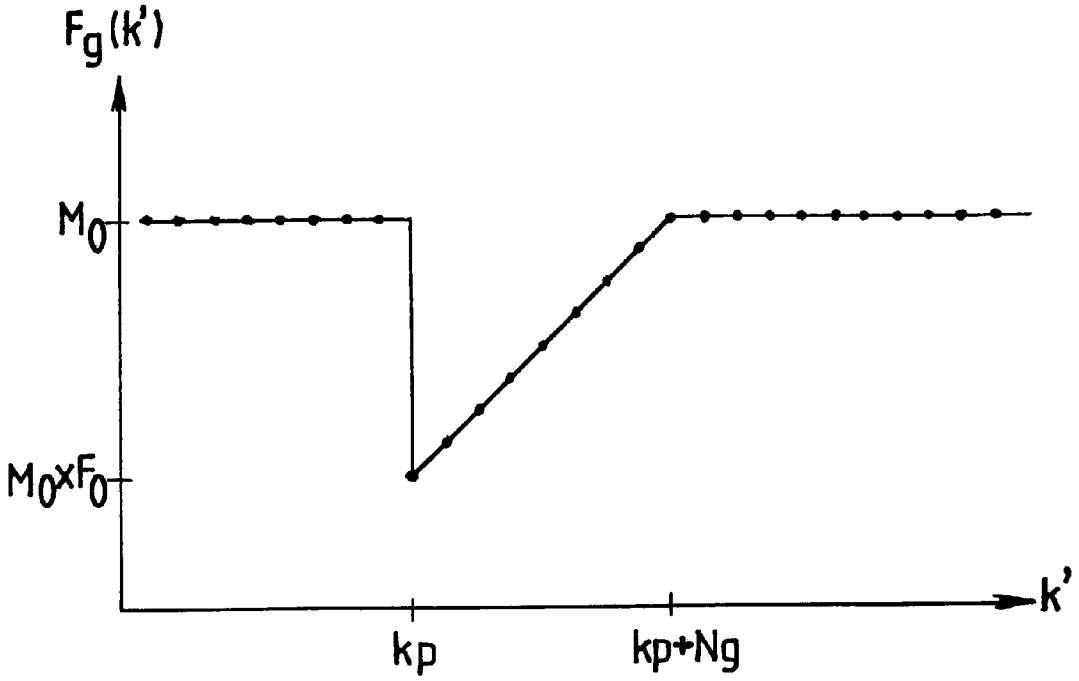
Figure 8:
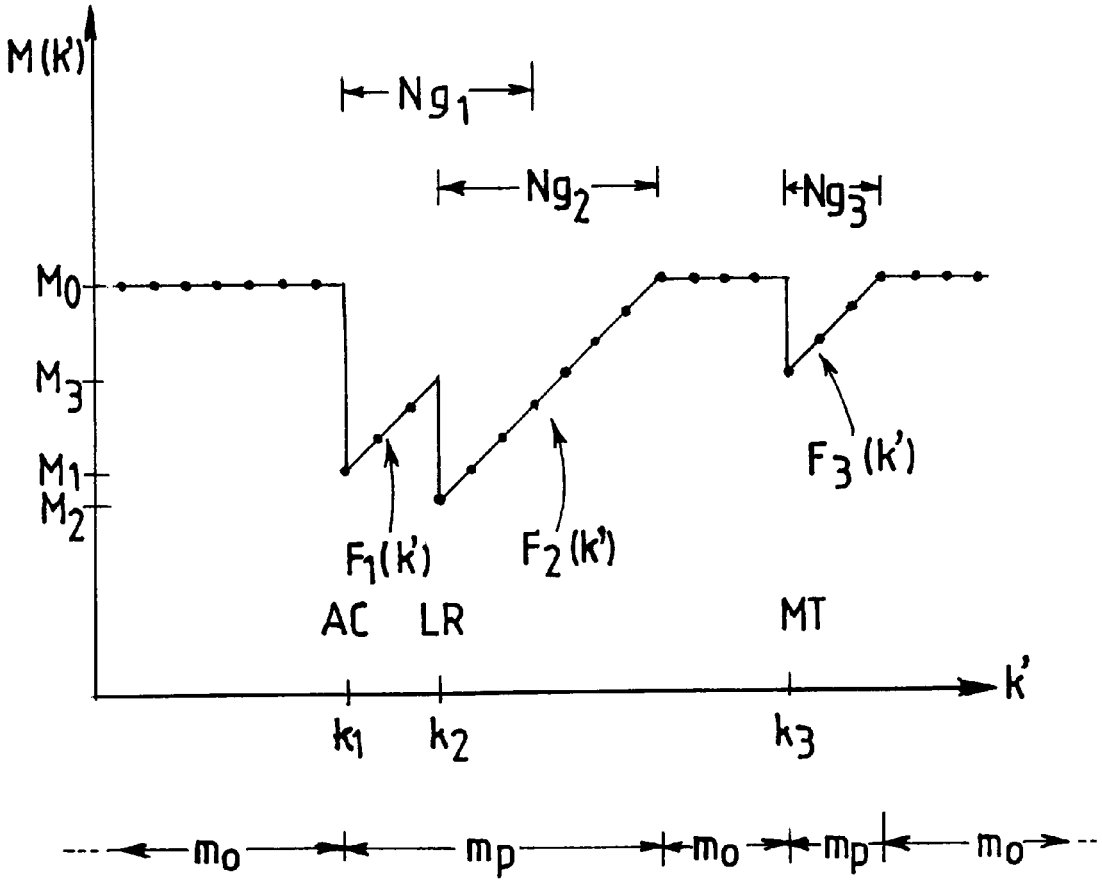

The invention is further described hereinafter by reference to the appended figures wherein:

FIG. 1 illustrates a transverse cross section view of a typical electrolysis cell intended for the production of aluminium, FIG. 2 illustrates a typical feeder device suitable to implement the invention, FIG. 3 shows a typical average variation of the actual alumina feeding needs of a cell caused by perturbative tending operations, FIGS. 4, 5 and 6 illustrate possible embodiments of a method according to the invention, FIG. 7 illustrates a possible component of a modulation factor according to the invention, and FIG. 8 illustrates a possible modulation factor according to the invention.

As illustrated in FIG. 1, an electrolysis cell (1) intended for the production of aluminium by igneous electrolysis comprises a pot (2) and a steel shell (3) lined with a refractory material (4, 4'). A pot (2) is generally rectangular, when viewed from above.

The pot (2) further includes a cathode arrangement (5) and a plurality of collector bars (6) made of an electrically conducting material, such as steel, or a combination of conducting members, such as steel and copper members. The cathode arrangement (5) typically includes a plurality of carbonaceous cathode blocs that form a bottom in the pot. The collector bars (6) protrude from the pot (2), and more specifically from the shell (3), for electrical connection thereto.

As further illustrated in FIG. 1, an electrolysis cell (1) also includes a plurality of anodes (10, 10'), which are typically made of a carbonaceous material, usually a prebaked carbonaceous material. The anodes (10, 10') are connected to external electrical conductors (not illustrated) using anode stems (11, 11') sealed in the anodes and secured to common conductors (12, 12') called anode beams using removable connectors (not illustrated).

When a cell is being operated, the pot (2) contains an electrolytic bath (7) that typically includes fluorides of sodium and aluminium, usually non stoichiometric cryolite, and possibly additives, such as calcium fluoride. In most industrial plants, the electrolytic bath (7) is usually acid in the sense that it contains excess amounts of aluminium fluoride ($AlF_3$) compared to the stoichiometric amounts corresponding to the chemical formula for cryolite, namely $Na_3AlF_6$ or $3.NaF—AlF_3$. The excess amounts of aluminium fluoride ($AlF_3$) are typically between 9 and 13 wt. %. In operation, the electrolytic bath (7) further contains alumina dissolved therein.

The anodes (10, 10') are partially immersed in the electrolytic bath (7) and are protected from oxidation by a protecting layer (9) that contains alumina and, possibly also, crushed bath. The protecting layer (9) is made from powdery material that is added to the cell and forms a crust over the anodes and bath that acts as a blanket.

In operation, an electrical current having intensity I is circulated through the cell, and in particular between the anodes (10, 10') and cathode arrangement (5), so as to reduce the alumina contained in the electrolytic bath (7) and thereby produce liquid aluminium through electrochemical processes. The liquid aluminium so produced progressively accumulates at the bottom of the pot to form a layer (8) called a pad on the top surface of the cathode arrangement (5). Liquid aluminium is regularly extracted from a cell for further transformation, such as alloying and/or casting. The extraction of liquid aluminium from a cell is usually referred to as a metal tapping operation.

Since the alumina contained in the electrolytic bath (7) is progressively consumed by the electrolysis process, alumina must be regularly added to the cell so as to maintain the alumina concentration in the bath. In industrial practice, most regulation methods aim at obtaining a concentration of alumina dissolved in the electrolytic bath within a specified range of values. The alumina concentration in the bath is typically between 1 and 3.5 wt. %, and preferably between 1.2 and 2.0 wt. %. Alumina is added in powder form and may possibly contain fluorine adsorbed therein.

Alumina is typically supplied to an electrolytic bath (7) according to a method including forming at least one opening (13) in the protecting layer (9) at specific locations in the cell and adding specified amounts of alumina to the electrolytic bath (7) through the opening (13).

Nowadays, alumina is supplied to an electrolysis cell and fed to the electrolytic bath (7) using feeder devices (20)—known as point feeder devices—that are capable of delivering finite amounts of alumina powder at a specified location in an electrolysis cell. The point feeder devices (20) typically deliver specified quantities (volume or weight) of alumina. As illustrated in FIG. 2, a feeder device (20) usually includes a hopper (30) and a crust breaker (40).

The hopper (30) includes a reservoir (31), a trough or chute (32), a proportioner (33) and a first actuator (34), which is typically a pneumatic jack. The proportioner (33) is a measuring means that delivers specified amounts of powder material coming from the reservoir (31) upon actuating the first actuator (34), typically upon electrical and/or pneumatic command.

The crust breaker (40) includes a chisel (41) and a second actuator (42), which is typically a pneumatic jack. The chisel (41) is moved downwards to form or maintain an opening (13) in the protecting layer (9) and upwards to leave room for the insertion of alumina in the electrolytic bath (7) through the opening (13). In FIG. 2, the chisel (41) is illustrated in its upward position (full lines) and its downward position (broken lines).

Actuation of the first and second actuators (34, 42) is advantageously done automatically using a control system.

An electrolysis cell usually comprises a specified number N of feeder devices (20), where N is typically between 1 and 10, inclusively.

Alumina is added to an electrolytic bath (7) at a feed rate that is adjusted so as to compensate the rate of reduction of alumina into metallic aluminium. A feed rate corresponds to an amount of alumina added to the electrolytic bath (7) of a cell (1) per unit time and is typically expressed as an average volume or mass of alumina added to a cell per unit time.

Furthermore, an electrolysis cell usually undergoes various tending operations without interrupting the current, such as the addition or extraction of bath, the changing of the position of the anodes, the replacement of worn anodes by new ones and the timely extraction of liquid aluminium.

The anodes (10, 10') are consumed during electrolytic reduction of alumina into aluminium. The progressive consumption of the anodes requires the replacement of worn anodes by new anodes. An anode replacement operation typically includes breaking the protecting layer (9) around a worn anode, removing the worn anode from the cell and inserting a replacement anode in the cell. The anode replacement operation is terminated by restoring the protecting layer (9) by adding a powder material containing alumina on and around the replacement anode.

The extraction of liquid aluminium from a cell is also part of the normal tending operations that are performed on electrolysis cells. The extraction is typically done by tapping out liquid aluminium using a siphon and a ladle. More precisely, a ladle equipped with a pipe is brought close to an electrolysis cell, the free end of the pipe is immersed in the pad of liquid aluminium (8), and liquid aluminium is sucked out of the cell and transferred into the ladle through the pipe.

The apparent feeding needs of electrolysis cells diminish during certain perturbative tending operations, such as anode replacement operations, restoration of the protecting layer or metal tapping operations, and in the aftermath of the same. Indeed, the perturbative tending operations cause the drop of amounts of solid alumina from the protective layer (9) into the electrolytic bath (7). This excess alumina reduces the needs of a cell for a while after its introduction in the bath. The Applicants noted that the amounts of excess alumina are important and significantly impact upon the functioning of electrolysis cells and endeavoured to quantify these interfering phenomena. In particular, the Applicants recorded the apparent needs of several cells and observed that they follow typical curves as a function of time t, such as the one illustrated in FIG. 3. This figure shows that the apparent feeding needs AN decrease shortly after the replacement of a worn anode (AC), after the restoration of the protecting layer around a new anode (LR) and after the tapping of liquid aluminium from the cell (MT). FIG. 3 further shows that the apparent feeding needs progressively tend towards a normal feed rate $AN_o$ after these perturbative tending operations, meaning that the superfluous alumina added to a cell during the perturbative tending operations is progressively consumed and that the needs of the cell progressively revert to normal feeding needs.

According to the invention, the method of producing aluminium in an electrolysis cell includes identifying perturbative tending operations on the cell (1) that can introduce superfluous alumina in the electrolytic bath (7).

In order to control the alumina concentration in the electrolytic bath (7), the method of producing aluminium according to the invention includes setting up a succession of control periods of duration T. The duration T of the control periods is preferably the same for all periods, so as to simplify the implementation of the method. The duration T is preferably between 1 and 300 seconds, and typically between 10 and 100 seconds.

Alumina is added during each control period at a feed rate SR that is specified for each control period. More precisely, a feed rate SR(k') is determined for a subsequent control period k' using information gathered and/or measurements made during at least one previous control period k, i.e., during at least one of the previous control periods k'−1, k'−2, k'−3, . . . that precede the subsequent control period k'.

The subsequent control period k' is usually the control period that just follows the previous control period, i.e., k'=k+1. Once the subsequent control period has elapsed, the subsequent control period k' usually becomes the previous control period k for the next step of the regulation process.

When a cell is supplied with alumina using point feeder devices (20) the method typically includes actuating the delivery of an amount $Q_o$ of alumina by each feeder device (20) at successive time intervals δt (thereby delivering a total amount $Q=N\times Q_o$ to the cell during each time interval δt, where N is the number of point feeder devices (20) in the cell), so as to give rise to an effective feed rate (equal to $N\times Q_o/\delta t$) that is equivalent to said specified feed rate SR(k'). The point feeder devices (20) typically provide the whole amount $Q_o$ of alumina in a single shot. The N feeder devices (20) may be actuated simultaneously or alternately or one after the other during each time interval δt, so long as they are all actuated during each time interval δt. The time interval δt are typically between 10 and 200 seconds. The amount $Q_o$ of alumina is typically between 0.5 and 5 kg, and preferably between 1 and 2 kg. Typically, the time interval δt to be used during a subsequent control period k' is set equal to $N\times Q_o/SR(k')$.

The Applicants have found that the amount $Q_o$ of alumina need not be an exact or exactly reproducible value because the method of the invention automatically adapts the feeding to the actual amounts of alumina delivered by the point feeders. This tolerance of the method makes it possible to properly regulate the feeding of electrolysis cells even when the amount $Q_o$ is not known precisely or is not a constant value, for example when the exact volume or weight of alumina delivered by the feeders is not known or when the density of the alumina powder varies over time. Hence, although the amount $Q_o$ is usually a specified amount, it may as well be a nominal amount. Advantageously, in the latter case, the method of the invention includes directly adjusting the duration of the time interval δt to be used during the subsequent control period k'. In other words, in the latter case, the feed rate is advantageously expressed in terms of shots per unit time rather than amounts (mass or volume) per unit time, as if the nominal amount $Q_o$ were a constant and precisely known parameter, and the method bypasses the determination of the specified feed rate SR(k') and applies the regulation scheme directly to the duration of the time interval δt.

A regulation method preferably takes into account the actual alumina concentration of the electrolytic bath. Since the alumina concentration cannot easily be measured directly most industrial methods rely on the measurement of an electrical parameter EP made on a cell to indirectly evaluate the concentration and control the same. The method according to the invention relies on an electrical parameter EP of the cell that is sensitive to the alumina concentration in the electrolytic bath (7) and can be used to monitor the same. Hence, the method according to the invention includes selecting an electrical parameter EP that is sensitive to the alumina concentration in the electrolytic bath (7).

The electrical parameter EP is typically a voltage drop U across a cell or an electrical resistance R attributed to a cell. The voltage drop U is typically measured between an anode beam (12, 12') or conductors connected thereto and collector bars (6) of the cathode arrangement (5) or conductors connected thereto. As a possible alternative, the current I circulating therein is also determined or measured and the electrical resistance R is calculated using a specific relationship between the voltage drop U and the current intensity I. The electrical resistance is advantageously given by the following relationship: R=(U−E)/I, where E is a back electromotive force (e.m.f.). The current intensity I may be measured or determined during each period k. The back electromotive force E is typically set equal to a value between 1.5 V and 1.9 V. It has been established that, for a given distance between the anodes (10, 10') and the pad of liquid aluminium (8), the voltage drop U or electrical resistance R are a function of the actual alumina concentration in the electrolytic bath (7). This function decreases quickly when the concentration is between about 1 wt. % and about 3 wt. %, reaches a minimum at about 3.5 wt. % and increases slowly above 3.5 wt. %.

The electrical parameter EP is measured, at least once, during each control period and a rate of variation P(k) of the electrical parameter EP is determined during at least one previous control period k. The rate of variation P(k) is determined using at least the measurements of the electrical parameter EP made during the control period k that just precedes the subsequent control period k', i.e., during the control period k=k'−1. Typically, the rate of variation P(k) is determined using measurements of the electrical parameter EP made during a specified number $N_m$ of control periods that just precede the subsequent control period k', i.e., during the control periods k'−1, k'−2, . . . , k'−$N_m$, where $N_m$ is typically between 1 and 60, inclusively. The specified number $N_m$ of control periods is usually selected so that it encompasses a period of time that is typically between 5 and 60 minutes.

In order to take into account the impact of the tending operations, the method of the invention further includes noting the performance of the perturbative tending operations on the cell (1). More precisely, the method includes noting the control periods $k_p$ during which any one of the perturbative tending operations on the cell (1) is deemed to be initiated.

According to the invention, alumina is added during each subsequent period k' at specified feed rate SR(k') that is set equal to M(k')×B(k'), where B(k') is a regulation feed rate that corresponds to a steady-state feed rate, i.e., a feed rate that is suitable in the absence of perturbative operations, and M(k') is a modulation factor that compensates the perturbations to the cell caused by the selected tending operations. The modulation factor M(k') makes it possible to distinguish and take into account the substantially stable situations in which no perturbative tending operation has taken place for a long while and the perturbed situations in which recent perturbative tending operations have added excess amounts of alumina to the cell, such as anode replacement operations, restorations of the protecting layer or metal tapping operations, that usually introduce significant amounts of alumina in the electrolytic bath. The anode replacement operations include the breaking of the protecting layer around a worn anode, the removal of the worn anode and the insertion of a replacement anode. After the replacement of an anode, the protecting layer is restored around the replacement anode.

The regulation feed rate B(k') and the modulation factor M(k') are determined for each subsequent control period k'.

In order to accurately control the alumina concentration in the electrolytic bath (7), the regulation feed rate B(k') alternates between at least a slow feed rate, that corresponds to an underfeeding of the cell, and a fast feed rate, that corresponds to an overfeeding of the cell. More precisely, the method of the invention includes selecting at least a slow feed rate $B_s$ and a fast feed rate $B_f$, and determining a regulation feed rate B(k') for a subsequent control period k' by setting the regulation feed rate B(k') equal to the fast feed rate $B_f$ when an overfeeding criterion has been met and equal to the slow feed rate $B_s$ when an underfeeding criterion has been met. Typically, the slow feed rate $B_s$ is set to a value that is between 10% to 50%, more typically between 20% and 35%, and preferably between 20% and 30%, inclusively, below the basic alumina consumption rate of a cell, while fast feed rate $B_f$ is set to a value that is between 10% to 50%, more typically between 20% and 35%, and preferably between 20% and 30%, inclusively, above the basic alumina consumption rate of a cell. The basic alumina consumption rate of a cell is usually set equal to the actual needs of a cell, which is typically determined by recording the total amount Qt of alumina added to the cell during at least one specified period of time and by reckoning a corresponding average or median rate (i.e., amount of alumina per unit time).

A modulation of the feed rate according to the invention makes it possible to correct the regulation feed rate B(k') so as to better correspond to the actual needs of a cell while maintaining the alternation of the regulation feed rate B(k') between at least a slow feeding rate and a fast feeding rate. The Applicants have observed that this approach secures an accurate control of the effective feed rate of a cell and efficiently reduces the rate of occurrence of anode effects owing to a tight control on the full swing of the alumina concentration in the bath, especially during the underfeeding phases.

The method of the invention typically includes initiating a sequence of control periods by setting the regulation feed rate B(1) of a first control period equal to $B_s$.

Advantageously, the method includes:

determining a basic feed rate $B_o$, selecting at least a slow feed rate coefficient $K_s$ that is smaller than one (i.e., $K_s$<1) and setting the slow feed rate $B_s$ equal to $B_o \times K_s$, selecting a fast feed rate coefficient $K_f$ that is larger than one (i.e., $K_f>1$) and setting the fast feed rate $B_1$ equal to $B_o \times K_f$.

The slow feed rate coefficient $K_s$ is typically between 0.5 and 0.9, more typically between 0.65 and 0.8, and preferably between 0.7 and 0.8, inclusively. The fast feed rate coefficient $K_f$ is typically between 1.1 and 1.5, more typically between 1.2 and 1.35, and preferably between 1.2 and 1.3, inclusively.

The regulation feed rate B(k') normally corresponds to an overfeeding of a cell when it is larger than $B_o$ and to an underfeeding of a cell when it is smaller than $B_o$. The feed rate coefficient K, and thus the regulation feed rate B(k'), usually alternates between at least an underfeeding phase (ph1) during which the feed rate coefficient K is equal to a slow feed rate coefficient $K_s$ (and during which the regulation feed rate B(k') is equal to a slow feed rate $B_s$) and an overfeeding phase (ph2) during which the feed rate coefficient K is equal to a fast feed rate coefficient $K_f$ (and during which the regulation feed rate B(k') is equal to a fast feed rate $B_f$). The number of control periods included in the phases is not predetermined: It results from the application of the decision scheme.

When point feeders are used and the duration of the time interval δt is directly adjusted instead of the feed rate, i.e. when the feed rate is expressed in shots per unit time, a slow feed time interval $\delta t_s$, a fast feed time interval $\delta t_f$ and a basic feed time interval $\delta t_o$ may be substituted for the slow feed rate $B_s$, the fast feed rate $B_f$ and the basic feed rate $B_o$, respectively.

FIG. 4 illustrates a possible embodiment of the invention. According to this embodiment, successive time intervals δt are specified and an amount $Q_o$ of alumina is added by each feeder device (20) at each specified time interval δt, so as to give rise to an effective feed rate equal to $N \times Q_o/\delta t$ (FIG. 4(A)). Conveniently, the method includes setting a reference time interval $\delta t_o$ and setting an actual time interval δt equal to $\delta t_o/K$, where K is a time adjustment coefficient (FIG. 4(B)). The reference time interval $\delta t_o$ is typically between 10 and 200 seconds. The time adjustment coefficient K corresponds to the feed rate coefficients that are selected to calculate the regulation feed rate B(k').

As illustrated in FIGS. 4(A), 4(B) and 4(C) the regulation feed rate alternates between a slow feed rate with $\delta t=\delta t_o/K_s$ (corresponding to $B(k')=B_o \times K_s$) and a fast feed rate with $\delta t=\delta t_o/K_f$ (corresponding to $B(k')=B_o \times K_f$), where $B_o=N \times Q_o/\delta t_o$. As illustrated in FIG. 4(C), this possible embodiment generates a series of regulation cycles $RC_i$, each cycle comprising a first phase ph1 and a second phase ph2 and each phase including at least one control period (in the example represented in FIG. 4(C) the phases each include three control periods). The total duration $RT_i$ of a regulation cycle results from the regulation process.

Advantageously, the regulation feed rate coefficient or time adjustment coefficient K is selected from a limited number of values. For example, the regulation feed rate coefficient K is advantageously selected from a group consisting of a least a slow feed rate coefficient $K_s$, with $K_s<1$, and at least a fast feed rate coefficient $K_f$, with $K_f>1$.

The basic feed rate $B_o$ is preferably equal to an estimated value for the needs of the cell that can be determined using Faraday's law (which provides that $B_o$ is about equal to 1.06× I×current efficiency (kg alumina/min), where the current intensity I is given in 100 kA). The basic feed rate $B_o$ may be a constant value. Preferably, however, the basic feed rate $B_o$ is adjusted so as to be substantially equal to a value corresponding to the actual needs of a cell, which are preferably evaluated when no perturbative tending operations have recently taken place. Processes for adjusting the basic feed rate $B_o$ are described below. The Applicants noted that an adjustment of the basic feed rate $B_o$ makes it possible to further improve the alumina control and thus further reduce the number of anode effects.

When the time interval δt is directly adjusted instead of the feed rate, an adjusted basic feed time interval $\delta t_o$ may be determined from the adjusted basic feed rate $B_o$ using the relationship $\delta t_o=N \times Q_o/B_o$, where $Q_o$ is the nominal amount $Q_o$ of alumina provided by each point feeder.

Preferably, the method of the invention includes selecting a specific number $N_d$ of control periods, determining the basic feed rate $B_o$ according to a first scheme when none of the said perturbative tending operations has been initiated less than the specific number $N_d$ of control periods before a given subsequent control period k' and determining the basic feed rate $B_o$ according to a second scheme when one of the said perturbative tending operations has been initiated less than the specific number $N_d$ of control periods before a given subsequent control period k'.

According to an advantageous embodiment of the invention, the basic feed rate $B_o$ is set equal to a constant value $\beta_o$ during the specific number $N_d$ of control periods that follow the control period $k_p$ during which any one of the perturbative tending operations on the cell (1) is initiated. In other words, the basic feed rate $B_o$ is set equal to a constant value $\beta_o$ during the perturbed periods, which are deemed to last $N_d \times T$ control periods. This embodiment aims at avoiding substantial drift of the regulation feed rate B(k') during the perturbed time intervals that follows the initiation of perturbative tending operations. The constant value $\beta_o$ is typically set equal to the value of $B_o$ that was determined for use during the control period $k_p$.

An adjustment process may be to record the actual needs of a cell. Typically, the basic feed rate $B_o$ is determined by recording the total amount Qt of alumina added to the cell during at least one reference period A of duration D and by setting the basic feed rate $B_o$ equal to Qt/D or an average or median value of Qt/D. The reference period A is preferably selected in a quiescent period of the regulation process, so as to avoid the impact of perturbative tending operations on the evaluation of the needs of a cell.

According to another process for adjusting the basic feed rate, an effective feed rate B is calculated for at least one reference period A and the basic feed rate $B_o$ is set equal to a smoothed value β of the effective feed rates B obtained for one or more reference periods A.

In an advantageous embodiment, which was used in the comparative tests reported below, the method of the invention includes:

selecting a specific number $N_a$ of reference periods $A_j$ in at least one period of time when none of the said perturbative tending operations has been initiated less than the specific number $N_d$ of control periods before any one the reference periods $A_j$, determining the duration $D_j$ of each reference period $A_j$, determining a total amount $Q_j$ of alumina added to the cell (1) during each of the reference periods $A_j$, calculating an effective feed rate $B_j$ for each reference period $A_j$ with the relationship $B_j=Q_j/D_j$, and setting the basic feed rate $B_o$ equal to a smoothed value β of the effective feed rates $B_j$ obtained for each reference period $A_j$.

The basic feed rate $B_o$ so calculated is typically used during the whole reference period that just follows the specific number $N_a$ of reference periods $A_j$.

A reference period $A_j$ typically corresponds to the control periods included between the end of an underfeeding phase (ph1) and the end of the following underfeeding phase (ph1'), as illustrated in FIG. 4(C).

The specific number $N_d$ of control periods is equal to $T_{op}/T$, where $T_{op}$ is a duration attributed to the effects of any one of said perturbative tending operations. The duration $T_{op}$ is typically between 3 and 12 hours. The duration $T_{op}$ is usually determined by measurements. The duration of the perturbative tending operations are usually much shorter than the duration attributed to their effects, i.e., the perturbative tending operations are completed shortly after their being initiated as compared to the duration attributed to their effects.

The specific number $N_a$ of reference periods $A_j$ typically corresponds to the full reference periods $A_j$ that just precede the subsequent control period k'. FIG. 5(A) illustrates such a case in which the specific number $N_a$ of reference periods $A_j$ is equal to 6 and forms a continuous group of reference periods G for the calculation of a smoothed value β of the effective feed rates $B_j$, namely reference periods $A_{-1}$ to $A_{-6}$. The reference period $A_o$ which includes the subsequent control period k' is not part of the group.

When the specific number $N_a$ of reference periods $A_j$ overlap a tending operation (PO) or a period of time when at least one perturbative tending operation (PO) has been initiated less than the specific number $N_d$ of control periods before any one the reference periods N, then the corresponding reference periods $A_j$ are excluded from the calculation and, preferably, replaced by a corresponding number of reference periods $A_j$ that just precede the initiation of that perturbative tending operation. FIG. 5(B) illustrates such a case in which the specific number $N_a$ of reference periods $A_j$ is equal to 6 and is split into two continuous groups of reference periods (G1 and G2) for the calculation of a smoothed value β of the effective feed rates $B_F$ Group G1 includes reference periods $A_{-1}$, $A_{-2}$ and $A_{-3}$ while Group G2 includes reference periods $A_{-23}$, $A_{-24}$ and $A_{-25}$. The two groups are separated by a tending operation (PO) and the corresponding perturbated period, which lasts $N_d$ control periods. The reference periods $A_{-4}, \ldots, A_{-22}$ that overlap the perturbated period are not taken into account in the calculation of a smoothed value β of the effective feed rates $B_j$. The reference period $A_o$ which includes the subsequent control period k' is not part of the group.

In order to take into account the possible variations of the intensity I of the current that circulate through the cell, the method of the invention advantageously includes determining an average value <I> for the intensity I during each reference period $A_j$ and calculating the effective feed rate $B_j$ for each reference period $A_j$ using the relationship $B_j=(\langle I\rangle/I_o)\times(Qj/Dj)$, where $I_o$ is a reference current intensity.

The smoothed value β is typically an average value or a median value of the effective feed rates $B_j$ obtained for each reference period $A_j$. For example, in the case of an average value, the basic feed rate $B_o$ to be used may be set equal to $\beta=(B_1+B_2+\ldots+B_{Na})/N_a=(Q_1/D_1+Q_2/D_2+\ldots+Q_{Na}/D_{Na})/N_a$, where $B_1=Q_1/D_1$ is the effective feed rate calculated for j=1, $B_2=Q_2/D_2$ is the effective feed rate calculated for j=2, . . . , and $B_{Na}=Q_{Na}/D_{Na}$ is the effective feed rate calculated for $j=N_a$. For example, in the case of a median value, the values of $B_j$ are sorted and arranged in a series of increasing values: If the specific number $N_a$ of reference periods $A_j$ is odd, then the basic feed rate $B_o$ may be set equal to the value of $B_j$ that is in position $(N_a+1)/2$ in the series (the number of values of $B_j$ that are smaller than $B_o$ is then equal to the number of values of $B_j$ that are larger than $B_o$); if the specific number $N_a$ of reference periods $A_j$ is even, then the basic feed rate $B_o$ may be set equal to the algebraic average of the value of $B_j$ that is in position $N_a/2$ and of the value of $B_j$ that is in position $(N_a/2)+1$, i.e., the average value of the two successive values of $B_j$ that are in the middle of the series. The specific number $N_a$ of reference periods $A_j$ is greater or equal to one and is preferably from 3 to 30, typically from 4 to 12, inclusively.

In an advantageous variation of the invention, the method further includes calculating a first complementary smoothed value β' of the effective feed rates $B_j$ obtained for each reference period $A_j$ over a first complementary number $N'_a$ of reference periods $A_j$, where $N'_a>N_a$. The first complementary smoothed value β' is advantageously used as a reference value in a safety range for the allowable values of the basic feed rate Bo. More precisely, the method advantageously includes:

determining a first complementary smoothed value β' of the effective feed rates $B_j$ obtained for each reference period $A_j$ over a first complementary number $N'_a$ of reference periods $A_j$, selecting a first half-width $W_{max}$ and a second half-width $W_{min}$ for a safety range, setting the basic feed rate $B_o$ equal to $\beta'+W_{max}$ if a value obtained for $B_o$ is larger than $\beta'+W_{max}$, setting the basic feed rate $B_o$ equal to $\beta'-W_{min}$ if a value obtained for $B_o$ is smaller than $\beta'-W_{min}$.

Preferably, the first complementary number $N'_a$ of reference periods $A_j$ is very large, typically between 1000 and 5000, so as to provide a long term evaluation of the needs of a cell. The first complementary smoothed value β' and the first complementary number $N'_a$ of reference periods $A_j$ may then be referred to as a long-term smoothed value β' and a long-term number $N'_a$ of reference periods $A_j$, respectively.

The first half-width $W_{max}$ is typically between 0 and 15%, and more typically between 5 and 12%, of the first complementary smoothed value β' while the second half-width $W_{min}$ is typically between 0 and 15% and more typically between 5 and 12%, of the first complementary smoothed value β', the 0% value being used only for one of the half-widths at the same time.

In another advantageous variation of the invention, the method further includes:

selecting a second complementary number $N''_a$ of reference periods $A_j$, selecting a normal drift difference ΔB for the feed rate, determining the duration $D_j$ of each reference period $A_j$, determining the total amount $Q_j$ of alumina added to the cell (1) during each of the reference periods $A_j$, calculating an effective feed rate $B_j$ for each reference period $A_j$ with the relationship $B_j=Q_j/D_j$, calculating a second complementary smoothed value β" using the $N''_a$ reference periods $A_j$ that just precede the subsequent control period k', declaring that there is a feeding anomaly if the difference between the second complementary smoothed value β" and the product $B_o\times M(k')$ is larger than the normal drift difference ΔB, i.e., if $\beta''-B_o\times M(k')>\Delta B$.

The second complementary number $N''_a$ of reference periods $A_j$ is preferably between 1 and 5, inclusively. The second complementary smoothed value β" and the second complementary number $N''_a$ of reference periods $A_j$ may then be referred to as a short-term smoothed value β" and a short-term number $N''_a$ of reference periods $A_j$, respectively.

The second complementary smoothed value β" is typically an average value or a median value of the effective feed rates $B_j$ obtained for each reference period $A_j$. Hence, the second complementary smoothed value β" may be calculated using the same algorithms as the smoothed value β. However, the calculation of the second complementary smoothed value β" may include the reference periods $A_j$ that overlap a tending operation or a period of time when at least one perturbative tending operation has been initiated less than the specific number $N_d$ of control periods before any one the reference periods $A_j$. In other words, in contradistinction to the calculation of the smoothed value β, the calculation of the second complementary smoothed value β" does not exclude the perturbated periods.

Preferably, when the feeding is declared to be anomalous, the method includes corrective measures aiming at eliminating the cause or causes of the anomalous behaviour. Typically, the method includes feeding the cell with a calculated specified feed rate SR(k'), which may be set equal to the second complementary smoothed value β" or some other convenient value, and inspecting the cell to determine the cause or causes of the anomalous behaviour.

This variation was found to further limit the occurrence of anode effects by making it possible to identify an anomalous feeding behaviour of a cell and eliminate the source of the anomaly. Typically, such an anomaly results from the malfunctioning of a point feeder or the clogging of a feeding opening (13) in the protecting layer (9).

The normal drift difference ΔB is typically between 5% and 30%, and more typically between 10% and 15%, of the product $B_o \times M(k')$.

The underfeeding criterion is typically based on time. Conveniently, the time that has elapsed is given by the number $N_f$ of control periods that have been completed since the inception of the fast feed rate $B_f$. More precisely, the method of the invention includes counting the number $N_f$ of control periods elapsed since a regulation feed rate B(k') was last set equal to $B_f$ and setting the regulation feed rate B(k') equal to $B_s$ if $N_f \times T$ is larger than a specified overfeeding period of time $T_f$. According to this embodiment, the regulation feed rate B(k') is kept equal to the fast feed rate $B_f$ for a specified overfeeding period of time $T_f$, and set equal to the slow feed rate $B_s$ when the specified overfeeding period of time $T_f$ has elapsed. The specified overfeeding period of time $T_f$ is typically between 10 and 60 minutes.

The overfeeding criterion is based on at least one electrical parameter EP. According to the invention, the regulation feed rate B(k') is set equal to the fast feed rate $B_f$ when the rate of variation P(k) has exceeded a reference variation value $P_o$. In other words, the regulation feed rate B(k') is kept equal to the slow feed rate $B_s$ so long as the rate of variation P(k) of the electrical parameter EP is smaller than the reference variation value $P_o$, and set equal to the fast feed rate $B_f$ when the rate of variation P(k) of the electrical parameter EP has reached or exceeded the reference variation value $P_o$. The rate of variation P(k) corresponds to a slope. The reference variation value $P_o$ is typically between 10 and 200 pΩ/s if the electrical parameter EP is expressed as a resistance of the cell and typically between 5 and 50 μV/s, more typically between 10 and 30 μV/s, when the electrical parameter EP is expressed as a voltage of the cell.

According to an advantageous variation of the invention, the method further includes:

selecting a critical duration $D_c$, recording the time $T_{sf}$ elapsed since the regulation feed rate B(k') has last been set equal to the slow feed rate $B_s$, setting the regulation feed rate B(k') to a reduced value $B_c$ that is smaller than the slow feed rate $B_s$ at least once if $T_{sf}$ is larger than $D_c$ and if the rate of variation P(k) of the electrical parameter EP is still smaller than the reference variation value $P_o$.

The critical duration $D_c$ is typically between 15 and 60 minutes. The reduced value $B_c$ is typically between 1% and 10% of $B_s$, inclusively.

This variation makes it possible to maintain the duration of the regulation cycles $RC_i$ within an acceptable range and avoids strong fluctuations of the same.

In a preferred embodiment of this variation, the value $B_c$ smaller than the slow feed rate $B_s$ progressively decreases with time, typically linearly or in a stepwise fashion. For example, a method according to this variation may advantageously include:

selecting a critical duration $D_c$, selecting an incremental time duration $D'_c$, selecting an incremental underfeeding parameter $\Delta B_s$, recording the time $T_{sf}$ elapsed since the regulation feed rate B(k') has last been set equal to the slow feed rate $B_s$, setting the regulation feed rate B(k') equal to $B_s-(N_c+1)\times\Delta B_s$ if $T_{sf}$ is larger than $D_c+N_c\times D'_c$ and smaller than $D_c+(N_c+1)\times D'_c$ and if the rate of variation P(k) of the electrical parameter EP is still smaller than the reference variation value $P_o$, where $N_c$ is any integer number greater than or equal to zero.

The incremental time duration $D'_c$ is typically between 5 and 10 minutes, inclusively. The incremental underfeeding parameter $\Delta B_s$, is typically between 1 and 3% of $B_s$, inclusively.

This embodiment further favours a shortening of the duration of the regulation cycles $RC_i$.

As illustrated in FIG. 6(A), this embodiment creates a stepwise decrease of the regulation feed rate B(k') with an incremental decrease equal to $\Delta B_s$. In this example, which is further illustrated in FIGS. 6(B) and 6(C), the rate of variation P(k) of the electrical parameter EP has not yet exceeded the reference variation value $P_o$ when the time elapsed since the switch to slow feed rate $B_s$ exceeds the critical duration $D_c$. The regulation feed rate B(k') is then set to a value equal to $B_s-\Delta B_s$. Since the rate of variation P(k) of the electrical parameter EP has still not exceeded the reference variation value $P_o$ when a further time equal to the incremental time duration $D'_c$ has elapsed, the regulation feed rate B(k') is then set to a value equal to $B_s-2\times\Delta B_s$. Since the rate of variation P(k) of the electrical parameter EP has exceeded the reference variation value $P_o$ before a further time equal to the incremental time duration $D'_c$ has elapsed, the regulation feed rate B(k') is switched to the fast feed rate $B_f$ at the end of the control period during which that crossing occurred.

Preferably, the decrease of the regulation feed rate B(k') is limited to a safety minimum $B_{min}$ that is typically between 88% and 95% of $B_s$.

The critical duration $D_c$ and the incremental time duration $D'_c$ may be expressed in terms of a number of control periods $N_{dc}$ and $N'_{dc}$, respectively, using the relationships $N_{dc}=D_c/T$ and $N'_{dc}=D'_c/T$.

The modulation factor M(k') is selected so that an overall substantially constant supply of alumina is provided to the cell despite the superfluous alumina added to the cell (1) by the perturbative tending operations. The specified feed rate SR(k') is thereby reduced during and after the performance of perturbative tending operations until the superfluous alumina has substantially been consumed by the cell (1). The net result is an effective underfeeding that remains stable and close to the one selected for the regulation despite the occurrence of perturbative tending operations.

The modulation factor M(k') is typically between 0.80 and 0.95, inclusively, for an anode replacement operation and for a restoration of the protecting layer, typically between 0.90 and 1.00, inclusively, for a metal tapping operation, and conveniently equal to one when no perturbative tending operations are to be taken into account. Hence, the modulation generates effective slow and fast feed rates that are reduced compared to the selected slow and fast feed rates ($B_s$ and $B_f$), the reduction typically being smaller than or equal to 20%. Such predetermined and moderate modulation of the alternating feed rates makes it possible to shorten the duration of the reference periods Aj and to limit the disturbances to the bath temperature due to fluctuations in the amounts of added alumina.

In principle, the method of the invention generates a specific modulation factor $M_g(k')$ for each successive perturbative tending operation. Consequently, the modulation factor M(k') may a combination of the specific modulation factors $M_g(k')$. In order to take into account a limited number of preceding perturbative tending operations and, thus, avoid piling up an ever increasing number of corrective terms, the specific modulation factor $M_g(k')$ of any perturbative tending operation is preferably limited in duration. More precisely, only the perturbative tending operations that were initiated less then $N_g$ control periods before the subsequent control period k' are taken into account, where $N_g$ is a threshold number of periods attributed to each perturbative tending operation performed on the cell. The $N_g$ control periods before a subsequent control period k' correspond to the periods $k'-N_g$ to $k'-1=k$ that precede the control period k'. The modulation factor M(k') is preferably set equal to a constant value $M_o$ when no perturbative tending operation has been initiated less then a threshold number $N_g$ of control periods before the subsequent control period k'. In other words, each specific function $M_g(k')$ is a predetermined function of k' between an onset period $k_g$ and an end period $k_g+N_g$ and is preferably equal to $M_o$ at any other period. In this manner the perturbative tending operations that were performed before their threshold number $N_g$ of periods are no longer taken into account because their impact has substantially disappeared.

The threshold number $N_g$ of periods is typically so that $N_g \times T$ is between 2 and 10 hours for anode replacement operations, between 2 and 10 hours for restorations of the protecting layer and between 1 and 6 hours for metal tapping operations. The threshold number $N_g$ of periods thus sets a value for the number of periods during which a modulation of the feed rate is being applied. The threshold number $N_g$ of periods is typically equal to the specific number $N_d$ of control periods.

The use of a constant value $M_o$ when no perturbative tending operation has been initiated less then $N_g$ control periods before the subsequent control period k' simplify the implementation of the method according to the invention. The constant value $M_o$ is typically equal to one, so that the specified feed rate SR(k') is equal to the regulation feed rate B(k') when the impact of the perturbative tending operations have substantially disappeared.

The modulation factor M(k') is advantageously equal to a specified function $M_g(k')$ that corresponds to the most recent of the perturbative tending operations. In other words, the modulation factor $M_g(k')$ corresponding to the most recent perturbative tending operation supersedes the previous ones. This embodiment simplifies the implementation of the invention and has been found to be sufficient in most cases.

The specified function $M_g(k')$ is typically predetermined by monitoring, usually in a statistical manner, the apparent consumption rate of a given cell in the aftermath of the initiation of a perturbative tending operations. The apparent consumption rate is typically a strongly varying function of time during the few hours that follow a perturbative tending operation. The Applicants have noted that the apparent consumption rate follows fairly reproducible functions of time and that a simplified average curve could efficiently be used to represent these functions in the method of the invention. The specified function $M_g(k')$ may advantageously be predetermined by running the cell (1) or a similar cell thereto, by recording the resulting needs Q(t) of the cell as a function of time (before and after selected perturbative tending operations) and by setting $M_g(k')$ equal to a mathematical function that makes it possible to substantially match the resulting needs Q(t) during and after the performance of perturbative tending operations. The specified function $M_g(k')$ is typically a strongly varying function of k'.

The Applicants have found that the measured specified functions $M_g(k')$ could be advantageously replaced by preset mathematical functions $F_g(k')$ and still obtain substantially the same improvement of the alumina control. In order to simplify the implementation of the invention, the preset mathematical functions $F_g(k')$ may comprise one or more linear sections.

In particular, the following mathematical functions $F_g(k')$ has been found to be efficient:

$$F_g(k')=M_o \text{ for } k'<k_p;$$

$$F_g(k')=M_o\times(F_o+(1-F_o)\times(k'-k_p)/N_g) \text{ for } k_p\leq k'\leq k_p+N_g;$$

$$F_g(k')=M_o \text{ for } k'>k_p+N_g,$$

where $F_o$ is a constant.

This function, which is illustrated in FIG. 7, gives rise to a step when at the control period $k_p$ during which a perturbative tending operations is deemed to be initiated, reaches a minimum value $F_o \times M_o$ and linearly increases back to $M_o$ during the $N_g$ subsequent control periods. The minimum value $F_o$ for an anode replacement operation is typically selected between 0.80 and 0.95. The minimum value $F_o$ for a restoration of the protecting layer is typically selected between 0.80 and 0.95, inclusively. The minimum value $F_o$ for a metal tapping operation is typically selected between 0.90 and 1.00, inclusively.

FIG. 8 exhibits a typical modulation factor M(k') that may be used when the method aims at compensating the successive additions of superfluous alumina into the electrolytic bath (7) caused by the replacement of a worn anode (AC), which includes the breaking of the protecting layer (9) around a worn anode, the restoration of the protecting layer (9) by adding a powder material containing alumina on and around a new anode (LR), and the tapping of liquid aluminium from the cell (MT), which lowers the upper surface of the electrolytic bath and thereby weakens parts of the protecting layer (9).

As illustrated in FIG. 8, the modulation factor M(k') usually defines a succession of feeding modes that comprises quiescent feeding modes $m_o$ in which no perturbative tending operation impacts on the feed rate and a constant value $M_o$ is used for the modulation factor M(k') and perturbed modes $m_p$ in which at least one perturbative tending operation impacts on the feed rate and is taken into account through the specified functions $M_g(k')$, which are advantageously replaced by the mathematical functions $F_g(k')$.

In this example, the modulation factor M(k') is equal to $M_o$ shortly before the sequence of perturbative tending operations, is set equal to a first function $F_1(k')$ at period $k_1$ when the anode replacement is performed, is set equal to a second function $F_2(k')$ at period $k_2$ when the restoration of the protecting layer around a new anode is performed, is set equal to $M_o$ when $N_{g2}$ control periods have elapsed since the inception of $F_2(k')$, is set equal to a third function $F_3(k')$ when the tapping of liquid aluminium from the cell is performed and is set back to $M_o$ when $N_{g3}$ control periods have elapsed since the inception of $F_3(k')$. The first function $F_1(k')$ has a minimal value $M_1$, the second function $F_2(k')$ has a minimal value $M_2$ and the third function $F_3(k')$ has a minimal value $M_3$. In this example, the corrective functions $F_2(k')$ and $F_3(k')$ are so close in time that $F_2(k')$ has not yet reverted to $M_o$ when $F_3(k')$ is applied, i.e., the number of control periods between $k_3$ and $k_2$ is shorter than $N_{g1}$ (the time difference between $k_3$ and $k_2$ is shorter than $N_{g1}\times T$).

The modulation of the regulation feed rate through the use of a modulation factor M(k') according to the invention provides a global correction of the feed rate that efficiently takes into account the superfluous alumina added to the cells by the selected perturbative tending operations, while the adjustment of the regulation feed rate of the cells according to the invention provides a complementary correction of the feed rate that efficiently takes into account the actual needs of each individual cells in a series of cells.

Tests

Comparative tests were run to assess the impact of a method according to the invention on performance of aluminium electrolysis cells. The tests included observations on specified electrolysis cells and measurements on the same when they were operated using a method that initially comprised an alumina feeding process that corresponded to prior art and that was thereafter modified to conform to the invention.

In all tests the method included alternating the feed rate between at least a slow feed rate $B_s$ and a fast feed rate $B_f$. More precisely, the regulation feed rate B(k') was set equal to the fast feed rate $B_f$ if the rate of variation P(k') of the electrical resistance of a cell exceeded a reference variation value $P_o$, and set equal to the slow feed rate $B_s$ when the fast feed rate $B_f$ had been applied for a specified period of time.

The cells were initially operated according to an alumina feeding regulation method that used the alternation between the slow feed rate $B_s$ and the fast feed rate $B_f$ without any modulation of the regulation feed rate B(k'). In other words, the specified feed rate SR(k') was equal to the regulation feed rate B(k') that alternates between a slow feed rate $B_s$ and a fast feed rate $B_f$ without any modulation factor.

The method was thereafter modified so as to include a modulation of the feed rate according to the invention. More precisely, the specified feed rate SR(k') was set equal to M(k')×B(k'), where M(k') is a predetermined modulation factor that was set equal to a predetermined function of time when one or more perturbative tending operations had been initiated during any one of a specific number of control periods preceding control period k' and set equal to one otherwise.

In the tests described below, the modulation factor M(k') was similar to the one illustrated in FIGS. 7 and 8. The modulation factor M(k') was the same for all cells. $M_o$ was set equal to one. The duration T of control periods was equal to 15 seconds. The threshold number $N_g$ of control periods was selected so that $N_g\times T=6$ hours for anode replacement operations and for restorations of the protecting layer and $N_g\times T=3$ hours for metal tapping operations. The minimal value $M_o\times F_o$ (=$M_1$, $M_2$ or $M_3$) was set equal to 0.91 for anode replacement operations AC (i.e., $M_1$) and for restorations of the protecting layer LR (i.e., $M_2$) and set equal to 0.98 for metal tapping operations MT (i.e., $M_3$).

The method was further modified so as to include an adjustment of the basic feed rate $B_o$ according to the invention. The specific number $N_a$ of reference periods $A_j$ was equal to 6 and the specific number $N_d$ of control periods was equal to $N_g$. The basic feed rate $B_o$ was set equal to a smoothed value β of the effective feed rates $B_j$ obtained for each of the selected 6 reference period $A_j$ that preceded a control period k'. The smoothed value β was the median value of the 6 effective feed rates $B_j$. As illustrated in FIG. 5(A), the 6 reference periods $A_j$ were successive reference periods when no perturbative tending operations took place during the reference periods. As illustrated in FIG. 5(B), the 6 reference periods $A_j$ were split into two continuous groups when the reference periods overlapped a tending operation.

Test No. 1

A series of three prototype cells that had been boosted to about 500 kA were run for two years using the method described above. The current intensity-to-bath weight ratio was 62.5 kA/ton. The cells were equipped with alumina feeder devices.

The cells were run using a standard alumina feeding regulation method involving a slow feed rate $B_s$ and a fast feed rate $B_f$. The slow feed rate was about 25% below the average need of the cells (i.e. $K_s$=0.75) and the fast feed rate was about 25% above the average need of the cells (i.e. $K_f$=1.25).

The average rate of anode effects was observed to be about 0.1 Anode Effect per cell per day (AE/cell/day).

The alumina feed rate was then modified as detailed above so as to include a modulation mechanism according to the invention, while maintaining the slow feed rate at about 25% below the average need of the cells and the fast feed rate was about 25% above the average need of the cells. The modulation mechanism took into account the impact of the anode replacement operations and metal tapping operations.

The average rate of anode effects was then found to rapidly decrease to values below 0.01 AE/cell/day. Moreover, the results displayed an interval of time of 179 days without any anode effect, which corresponds to a rate of anode effects equal to 0.006 AE/cell/day.

Test No. 2

A group of 120 AP30 electrolysis cells were operated according to a standard alumina feeding regulation method using a slow feed rate $B_s$ and a fast feed rate $B_f$. The cells were equipped with alumina feeder devices. The slow feed rate was about 25% below the average need of the cells and the fast feed rate was about 25% above the average need of the cells.

The intensity of the current was 320 kA. The current intensity-to-bath weight ratio was 50 kA/ton.

The alumina feed rate was then modified as detailed above so as to include a modulation mechanism according to the invention, while maintaining the slow feed rate at about 25% below the average need of the cells and the fast feed rate was about 25% above the average need of the cells. The modulation mechanism took into account the impact of the anode replacement operations and metal tapping operations.

In both situations the corresponding effective underfeeding rate during the non perturbed periods and during the perturbed periods was determined and recorded for each cell.

This test revealed that the effective underfeeding rates were fairly uniform from cell to cell during the non perturbed periods but varied significantly from cell to cell during the perturbed periods. The implementation of a modulation mechanism according to the invention significantly reduced the average variation of the underfeeding rates during the perturbed periods (the average variation went from a value of about 12% to a value of about 6%).

The test further showed that the basic alumina consumption of the cells, which was determined during the non perturbed periods, varied significantly from cell to cell and that an adjustment mechanism of the regulation feed rate B(k') according to the invention makes it possible to take into account the specific needs of each cell.

Test No. 3

In a series of AP30 electrolysis cells of an aluminium production plant, a group of 140 cells was selected for a test that lasted several months. The cells included alumina feeder devices. The average intensity of the current that circulated in the cells was about 355 kA. The current intensity-to-bath weight ratio was 55 kA/ton.

The slow feed rate $B_s$ was about 30% below the average need of the cells and the fast feed rate $B_f$ was about 30% above the average needs of the cells. The specified period of time for the application of the fast feed rate $B_f$ was equal to 1500 seconds. The electrical parameter EP was expressed as a resistance of the cell and the reference variation value $P_o$ was set equal to 63 pΩ/s.

The cells were initially operated according to an alumina feeding regulation method that used the alternation between the slow feed rate $B_s$ and the fast feed rate $B_f$ without any modulation of the regulation feed rate B(k').

The group of 140 cells was then divided into a first subgroup and a second subgroup. Each subgroup included 70 cells. The cells of the first subgroup were intertwined with the cells of the second subgroup so as to make the two subgroups basically equivalent (more precisely, every second cell was allocated to the second subgroup).

The method of regulation of the first subgroup was kept unchanged.

The method of regulation of the second subgroup was modified so as to include a modulation of the feed rate according to the invention as detailed above.

For all cells of the group, the occurrence of anode effects, the current intensity, the amounts of alumina added to the cells, the amount of aluminium produced by the cells and the current efficiency were determined and recorded over time before and after the modification of the method of regulation in the second subgroup of cells. The period of time before the modification (hereafter called "first period of time") extended over about 6 months before the modification of the method of regulation in the second subgroup of cells while the period of time after the modification (hereafter called "second period of time") extended over about 4 months after the method of regulation was modified and fully implemented according to the invention in the second subgroup of cells.

The results obtained for the cells before and after modification of the method of regulation were analyzed in a statistical manner in order to reduce the influence of extraneous perturbations, such as changes in the ambient temperature around the cells and carbon dust formation periods. The statistical analysis showed that:

The average rate of occurrence of anode effects obtained in the second subgroup of cells during the second period of time was 45% lower than in the full initial group of cells during the first period of time. The average current efficiency in the second subgroup of cells during the second period of time was 0.47% higher than in the first subgroup of cells during the same period of time and 0.43% higher than in the full initial group of cells during the first period of time. Hence, the implementation of a method of regulation according to the invention significantly lowered the rate of occurrence of anode effects while it significantly increased the current efficiency.

Before the modification of the method of regulation of the second subgroup, the mean effective underfeeding rate gradually went from a maximum of about 7.5% below the selected slow feed rate $B_s$ (i.e., −22.5%) shortly after a change of anode to a value between 1% and 3% below the applied slow feed rate $B_s$ (i.e., between −28% and −29%) 12 hours after a change of anode, with fluctuations of the order of 1% due to other events such as metal tapping operations. As compared to the set value of 30% below the average need of the cells, the mean effective underfeeding rate thus amounted to a deviation that gradually went from about 25% (i.e., 7.5%/30%) to between about 3 and 10% (1%/30% and 3%/30%), with an average value of 8% over a full anode change cycle.

After the modification of the method of regulation of the second subgroup, the correction due to the modulation of the regulation feed rate B(k') gradually went from a maximum of about 6.5% below the selected slow feed rate $B_s$ (i.e., −23.5%) shortly after a change of anode to a value between 0.5% and 2% below the applied slow feed rate $B_s$ (i.e., between −28% and −29.5%) 10 hours after a change of anode, with fluctuations smaller than 0.5%. As compared to the set value of 30% below the average need of the cells, the correction managed to decrease the deviation to values smaller than 7% (i.e., 2%/30%), with an average value of 2% over a full anode change cycle.

Before the modification of the method of regulation of the second subgroup, the standard deviation of the spread of the effective underfeeding rate in this subgroup was equal to about 2%. Thus, 95% of the cells showed an effective underfeeding rate that was within ±4% of the average effective underfeeding rate of the second subgroup of cells. This amounted to a cell-to-cell fluctuation of about ±13% (i.e., ±4%/30%).

After the modification of the method of regulation of the second subgroup, the correction of the feed rate of each cell in the second subgroup due to the individual adjustment of the basic feed rate $B_o$ lowered the standard deviation to about 0.9%, which amounted to a cell-to-cell fluctuation of about ±6% (i.e., ±1.8%/30%).

Hence, the correction due to the modulation of the regulation feed rate B(k') predominates for all cells in the aftermath of a change of anode while the correction due to the individual adjustment of the basic feed rate $B_o$ makes it possible to reduce the number of stray cells.

NUMERAL REFERENCES

1 Cell
2 Pot
3 Shell
4, 4' Refractory material
5 Cathode arrangement
6 Collector bar
7 Electrolytic bath
8 Pad of liquid aluminium
9 Protecting layer
10, 10' Anodes
11, 11' Anode stem
12, 12' Anode beam
13 Opening
20 Feeder device
30 Hopper
31 Reservoir
32 Through or chute
33 Proportioner
34 First actuator
40 Crust breaker
41 Chisel
42 Second actuator

The invention claimed is:

1. Method of producing aluminium in an electrolysis cell, said cell comprising a pot, a plurality of anodes and at least one alumina feeder device capable of delivering amounts of alumina powder in said cell, said cell containing an electrolytic bath comprising alumina dissolved therein, said anodes and electrolytic bath being covered with a protecting layer made from a powdery material containing alumina, said method including:

circulating an electrical current having intensity I through said cell, so as to reduce said alumina and thereby produce liquid aluminium, performing tending operations on said cell, selecting an electrical parameter EP for said cell that is sensitive to the alumina concentration in said electrolytic bath, setting up a succession of control periods of duration T, measuring said electrical parameter EP during each control period, determining a rate of variation P(k) of said electrical parameter EP during at least one previous control period k, selecting at least a slow feed rate $B_s$ and a fast feed rate $B_f$, determining a regulation feed rate B(k') for a subsequent control period k' by setting said regulation feed rate B(k') equal to said fast feed rate $B_f$ if said rate of variation P(k) has exceeded a reference variation value $P_o$, and equal to said slow feed rate $B_s$ when an underfeeding criterion has been met, the underfeeding criterion indicating that underfeeding of said cell should commence, adding alumina at a specified feed rate SR(k') during said subsequent control period k', wherein said method further includes:

identifying perturbative tending operations on said cell that can introduce superfluous alumina in said electrolytic bath, noting the control periods $k_p$, during which any one of said perturbative tending operations on said cell is initiated, setting said specified feed rate SR(k') equal to M(k')×B(k'), where M(k') is a predetermined modulation factor that modulates said regulation feed rate B(k') so as to take into account a reduction of the needs of said cell induced by said superfluous alumina.

2. Method of producing aluminium according to claim 1, wherein said perturbative tending operations are selected from a group consisting of: anode replacement operations, restorations of the protecting layer and metal tapping operations.

3. Method of producing aluminium according to claim 1, wherein said modulation factor M(k') is equal to a constant value $M_o$ when no perturbative tending operation has been initiated less than a threshold number $N_g$ of control periods before said subsequent control period k'.

4. Method of producing aluminium according to claim 1, wherein said modulation factor M(k') is equal to a specified function $M_g(k')$ that corresponds to the most recent of said perturbative tending operations.

5. Method of producing aluminium according to claim 4, wherein said specified function $M_g(k')$ is equal to a preset mathematical functions $F_g(k')$ that is defined as $F_g(k')=M_o$ for $k'<k_p$; $F_g(k')=M_o\times(F_o+(1-F_o)\times(k'-k_p)/N_g)$ for $k_p\leq k'\leq k_p+N_g$; and $F_g(k')=M_o$ for $k'>k_p+N_g$, where $F_o$ is a constant.

6. Method of producing aluminium according to claim 1, wherein the method further includes:

determining a basic feed rate $B_o$, selecting at least a slow feed rate coefficient $K_s$ that is smaller than one and setting the slow feed rate $B_s$ equal to $B_o\times K_s$, selecting a fast feed rate coefficient $K_f$ that is larger than one and setting the fast feed rate $B_f$ equal to $B_o\times K_f$.

7. Method of producing aluminium according to claim 6, wherein said basic feed rate $B_o$ is equal to an estimated value for the needs of said cell.

8. Method of producing aluminium according to claim 6, wherein said basic feed rate $B_o$ is set equal to a constant value $\beta_o$ during a specific number $N_d$ of control periods that follow the control period $k_p$ during which any one of said perturbative tending operations on said cell is initiated.

9. Method of producing aluminium according to claim 6, wherein said method includes:

selecting a specific number $N_a$ of reference periods $A_j$ in at least one period of time when none of said perturbative tending operations has been initiated less than a specific number $N_d$ of control periods before any one of said reference periods $A_j$, determining the duration $D_j$ of each reference period $A_j$, determining a total amount $Q_j$ of alumina added to said cell during each of said reference periods $A_j$, calculating an effective feed rate $B_j$ for each reference period $A_j$ with the relationship $B_j=Q_j/D_j$, and setting said basic feed rate $B_o$ equal to smoothed value of said effective feed rates $B_j$ obtained for each reference period $A_j$.

10. Method of producing aluminium according to claim 9, wherein said specific number $N_d$ of control periods is equal to $T_{op}/T$, where $T_{op}$ is a duration attributed to the effects of any one of said perturbative tending operations.

11. Method of producing aluminium according to claim 9, wherein said method includes determining an average value <I> for said intensity I during each reference period $A_j$ and calculating said effective feed rate $B_j$ for each reference period $A_j$ with the relationship $B_j=(\langle I\rangle/I_o)\times(Q/D_j)$, where $I_o$ is a reference current intensity.

12. Method of producing aluminium according to claim 9, wherein said smoothed value β is an average value or a median value of the effective feed rates $B_j$ obtained for each reference period Aj.

13. Method of producing aluminium according to claim 9, wherein the method further includes:

determining a first complementary smoothed value β' of the effective feed rates $B_j$ obtained for each reference period $A_j$ over a first complementary number $N'_a$ of reference periods $A_j$, selecting a first half-width $W_{max}$ and a second half-width $W_{min}$ for a safety range, setting the basic feed rate $B_o$ equal to $\beta'+W_{max}$ if a value obtained for $B_o$ is larger than $\beta'+W_{max}$, setting the basic feed rate $B_o$ equal to $\beta'-W_{min}$ if a value obtained for $B_o$ is smaller than $\beta'-W_{min}$.

14. Method of producing aluminium according to claim 13, wherein the method further includes:

selecting a second complementary number $N''_a$ of reference periods $A_j$, selecting a normal drift difference ΔB for the feed rate, determining the duration $D_j$ of each reference period $A_j$, determining the total amount $Q_j$ of alumina added to the cell during each of the reference periods $A_j$, calculating an effective feed rate $B_j$ for each reference period $A_j$ with the relationship $B_j=Q_j/D_j$, calculating a second complementary smoothed value β" using the $N''_a$ reference periods $A_j$ that just precede the subsequent control period k', declaring that there is a feeding anomaly if the difference between the second complementary smoothed value β" and the product $B_o\times M(k')$ is larger than the normal drift difference ΔB.

15. Method of producing aluminium according to claim 1, wherein the method further includes:

selecting a critical duration $D_c$, recording the time $T_{sf}$ elapsed since the regulation feed rate B(k') has last been set equal to the slow feed rate $B_s$, setting the regulation feed rate B(k') to a reduced value $B_c$ that is smaller than the slow feed rate $B_s$ at least once if $T_{sf}$ is larger than $D_c$ and if the rate of variation P(k) of the electrical parameter EP is still smaller than the reference variation value $P_o$.

16. Method of producing aluminium according to claim 1, wherein said method further includes:

counting the number $N_f$ of control periods elapsed since said regulation feed rate B(k) was last set equal to $B_f$ and setting said regulation feed rate B(k') equal to $B_s$ if $N_f \times T$ is larger than a specified overfeeding period of time $T_f$.

17. Method of producing aluminium according to claim 1, wherein said electrical parameter EP is a voltage drop U across said cell or an electrical resistance R attributed to said cell.

18. Method of producing aluminium according to claim 1, wherein said cell includes N point feeder devices and wherein said method includes actuating the delivery of an amount $Q_o$ of alumina by each feeder device at successive time intervals at, so as to give rise to an effective feed rate that is equivalent to said specified feed rate SR(k').

19. Method of producing aluminium according to claim 18, wherein said time intervals δt are each set equal to $N \times Q_o/SR(k')$ during said subsequent control period k'.

20. Method of producing aluminium according to claim 1, wherein said slow feed rate $B_s$ corresponds to an underfeeding of the cell, and said fast feed rate $B_f$ corresponds to an overfeeding of the cell, based on a basic alumina consumption rate of the cell.

21. Method of producing aluminium according to claim 1, wherein said slow feed rate $B_s$ is set to a value that is between 10% and 50% below a basic alumina consumption rate of the cell, and said fast feed rate $B_f$ is set to a value that is between 10% and 50% above the basic alumina consumption rate of the cell.

* * * * *